United States Patent [19]

Jennings

[11] 4,052,944

[45] Oct. 11, 1977

[54] PORTABLE SHUFFLE DESK

[76] Inventor: Russell A. Jennings, 1513 Tilden, Wichita Falls, Tex. 76309

[21] Appl. No.: 633,945

[22] Filed: Nov. 20, 1975

[51] Int. Cl.[2] ..... A47B 23/00

[52] U.S. Cl. ..... 108/43; 108/44

[58] Field of Search ..... 108/43, 47, 44; 224/5 R; 312/235; 248/346; 297/456; 5/355, 361 R

[56] References Cited

U.S. PATENT DOCUMENTS

| | | | |
|---|---|---|---|
| 2,219,974 | 10/1940 | Bellow | 248/346 X |
| 2,701,173 | 2/1955 | Senior et al. | 108/43 |
| 2,979,990 | 4/1961 | Alexander | 108/43 X |
| 3,407,757 | 10/1968 | Warner | 108/43 |
| 3,767,094 | 10/1973 | Sikes | 108/44 X |
| 3,899,210 | 8/1975 | Samhammer et al. | 297/456 X |
| 4,011,611 | 3/1977 | Lederman | 297/456 X |

FOREIGN PATENT DOCUMENTS

| | | | |
|---|---|---|---|
| 220,337 | 1924 | United Kingdom | 108/43 |

*Primary Examiner*—Marion Parsons, Jr.
*Assistant Examiner*—Peter A. Aschenbrenner
*Attorney, Agent, or Firm*—M. Ted Raptes

[57] ABSTRACT

A portable desk for the convenience of invalids, traveling men or others who do not have access to other desk surfaces. The lower portion of the desk is a pillow-like portion of flexible material which forms a yieldable container which is partially filled with a dry, flowable material, such as expanded styrofoam beads, particles or the like. The casing portion is secured at the top to a piece of sub-covering of suitable size, which in turn is secured to a hard, planar sheet of material by adhesive, glue or other suitable means. The styrofoam beads may be shifted or shuffled about until the pillow-like portion adjusts to the contour of the surface on which it is to be used. An upstanding abutment secured along one side of the desk top forms a stop for books, pencils and the like to rest against.

11 Claims, 4 Drawing Figures

PORTABLE SHUFFLE DESK

SUMMARY OF THE INVENTION

This invention relates to a lightweight portable desk which may be used on regular irregular base surfaces and comprises two principal components, a hard, rectangular upper portion, which forms a desk surface, and a pillow-like bottom portion which is substantially filled with flowable material, which material can be shifted so as to adjust the bottom portion to a regular or an irregular base surface.

The pillow-like lower portion or casing is substantially filled with a lightweight flowable material, such as, sawdust, expanded styrofoam particles or beads, expanded polyurethane particles or beads or particles of other lightweight plastic material. Such material is of such density and looseness that it may be readily shifted within the casing so as to conform to the surface on which it is to be used. The bottom portion may also be so shifted or tilted as to give to the plane upper portion a desired position, to make it most effective while in use. That is, it may be tilted to support a book for a comfortable reading position or it may be made to assume a flat horizontal position for writing, playing cards or for numerous other activities.

A longitudinal stop member may be secured along a side of the plane upper portion, on which a book may be rested, or drawing or writing materials maintained on the top as the bottom is shifted, and the desk may be used with the stop member either at the top or the bottom of the plane upper surface, the desk may also be tilted or with the top level when in use.

The present device is so constructed that it may be readily used on the lap for writing or to support a book, with the hard planar surface arranged at such an angle as to be best suited to the activity, or it may be used in bed or on other irregular surface, and the material within the pillow-like bottom casing readily shifted or shuffled so the bottom of the pillow-like casing assumes the contour of the surface on which it is to be used, to position the hard planar surface in the particular position desired. The planar surface, when level, may be used to receive a snack tray, or the base of a slide or movie projector or the like.

PRIOR ART

The following prior art was noted, but no one of the patents taken alone or any combination of these patents is considered to anticipate the claims to the present invention: U.S. Pat. Nos. 2,471,003, 3,147,948, 3,147,949, and 3,407,757.

OBJECTS OF THE INVENTION

An object of this invention is to provide a lightweight portable desk which has a hard planar upper surface and a lower, pillow-like casing which is filled with a lightweight dry, flowable material which may be shifted so that the pillow-like bottom casing can be made to conform to almost any regular or irregular surface, so the hard planar surface may be positioned in the desired plane.

Another object of this invention is to provide a lightweight portable desk which is mounted on a pillow-like casing so the lightweight dry flowable material, contained therein to substantially fill the casing, will adjust to a surface that is not compatible with the hard upper surface of the desk.

Still a further object of this invention is to provide a lightweight portable desk which may be used almost anywhere, on almost any surface, which is light in weight, is durable and relatively inexpensive to manufacture.

Another object of the invention is to provide a lightweight portable desk which may be easily used by invalids, traveling men, children or any one whose work space is constricted or whose physical capabilities are restricted.

Yet another object of the invention is to provide a lightweight desk surface which can be adjusted to be horizontal for use as a TV snack tray or utility tray, or it can be placed at an infinite number of angles simply by shuffling the material inside the pillow for maximum comfort while reading, writing or sketching.

A further object of the invention is to provide an excellent base for tilting a slide or movie projector at the desired angle.

Still another object of the invention is to provide a lightweight portable desk for use at home, school dorm, office, car, motel, camping, in an air plane and in hospitals, which is light in weight, easy to handle, requires little space, and which is simple in construction.

DETAILED DESCRIPTION OF THE INVENTION

Figure 1:
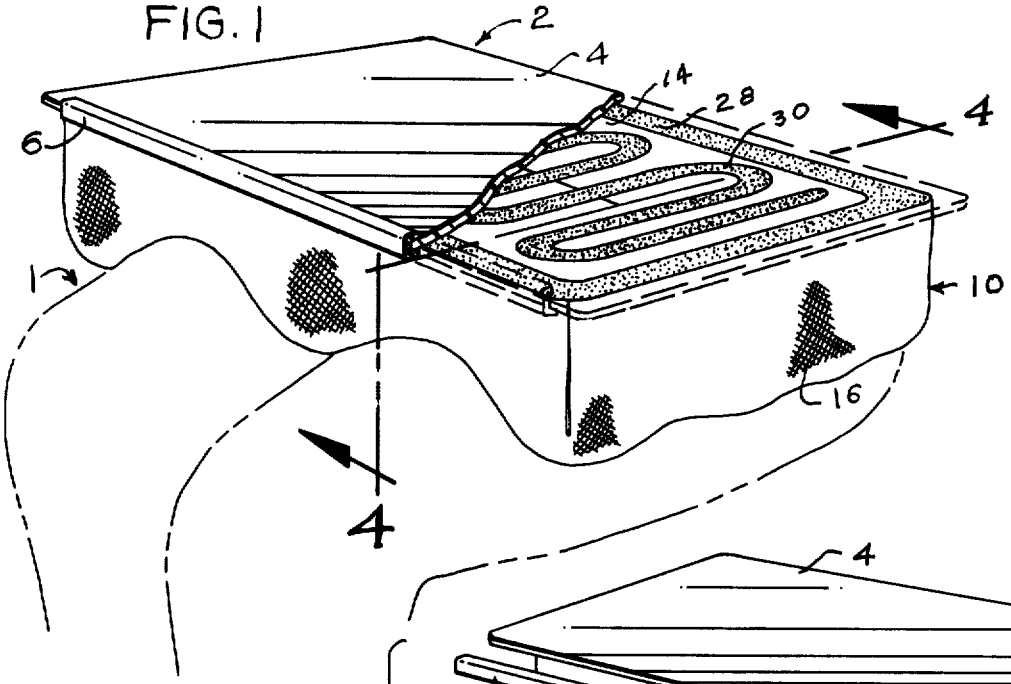
FIG. 1 is a perspective view of the lightweight portable desk, showing the desk placed in the lap of the user, the legs of the user being shown in dot-dash outline, showing the pillow-like bottom portion of the desk contoured to fit the legs on which it rests and showing a portion of the top of the desk as broken away and in section to bring out the details of construction and showing a portion thereof in dashed outline, the cementing arrangement being shown on a sub-cover.

With more detailed reference to the drawing, in which like reference characters designate like parts in the several views thereof, the numeral 1 designated generally an irregular surface, such as the lap of the user. The numeral 2 designates generally the lightweight portable desk of this invention having a sheet of material 4, which may be plastic, hardboard or other suitable hard material, to form a desired planar surface, which surface is adapted to support an article, such as a book, or drawing or writing material, a snack tray, a movie projector base or the like.

Figure 3:
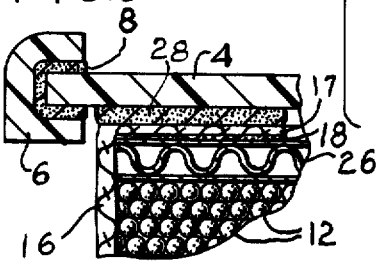
FIG. 3 is an enlarged, fragmentary sectional view of a side view of a portion of the portable desk, showing the longitudinal stop cemented to an edge of the desk and showing various layers of cementitious material between the inturned fabric edges of the lower pillow-like casing portion of the desk and the upper sub-cover of the top portion of the desk.
Figure 4:
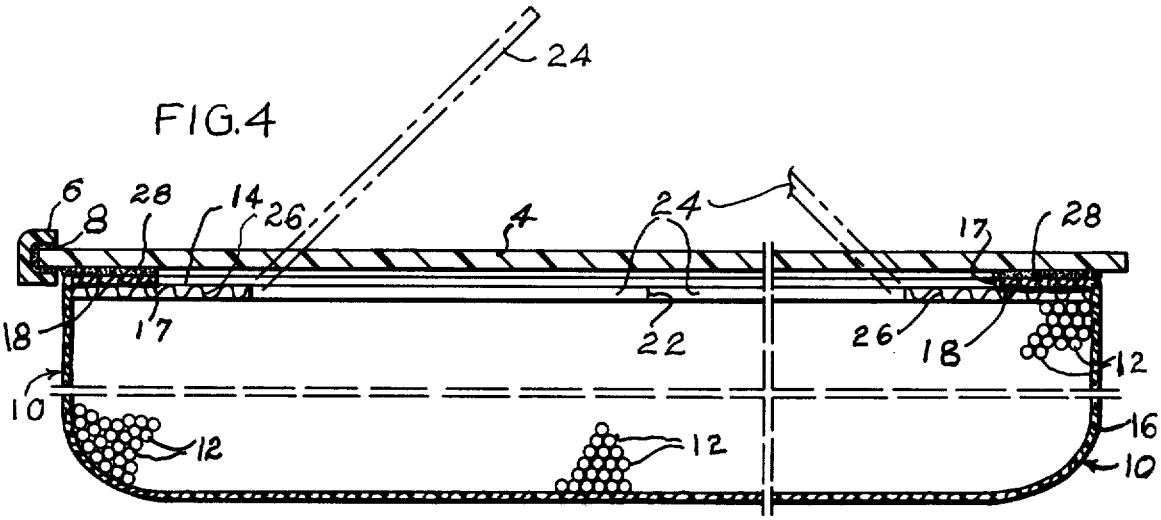
FIG. 4 is an enlarged transverse, sectinal view taken on the line 4—4 of FIG. 1, looking in the direction indicated by the arrows, with parts broken away and with parts shortened, and with parts being shown in dot-dash outline, in raised position, the closed position of which parts is shown in full outline.

The sheet of material 4 has a longitudinal stop 6 along one edge thereof and secured thereto, as by cement 8, as will best be seen in FIGS. 3 and 4. The portable desk has a bottom portion which is a flexible, pillow-like casing, designated generally at 10, with a lightweight flowable granular material 12 substantially filling the casing 10. The material 12 may be sawduct, expanded foam plastic material such as styrofoam, either expanded beads or particles, expanded polyurathane beads or granules.

The pillow-like bottom casing may be made of fabric, plastic material, leather or other suitable pliable material which will yield to a regular or an irregular surface.

Figure 2:
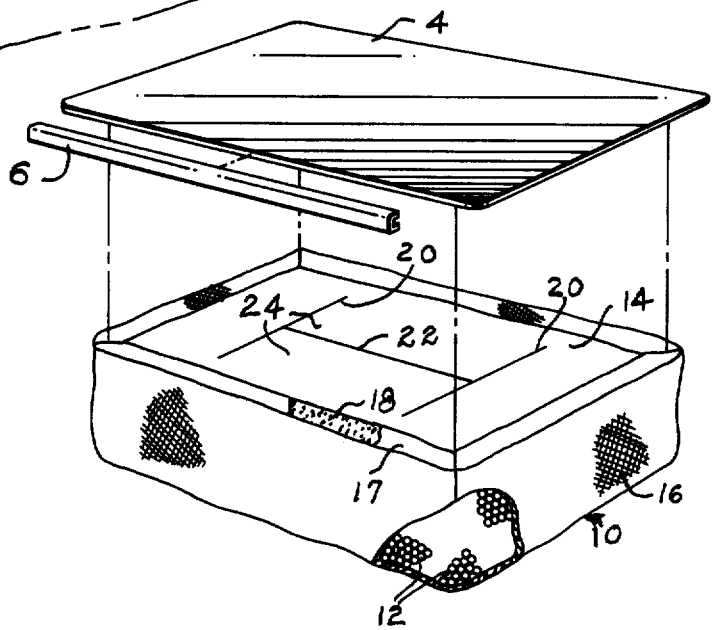
FIG. 2 is an exploded view of the hard top surface portion of the desk, showing a longitudinal stop in exploded relation outward therefrom, and showing a sub-cover portion of the desk, with slits formed therein to enable the pillow-like bottom portion to be substantially filled with a lightweight dry, flowable material, such as styrofoam beads or the like, with parts being broken away and shown in section to show the interior of the bottom portion with the styrofoam beads therein, and with a portion broken away to show adhesive between the sub-cover of the desk and the underside of the overlapping fabric of the pillow-like casing.

The portable desk 2 has a sheet of material 14 which is at least partially rigid and is corrugated, as indicated at 26, which sheet of material 14 forms a sub-cover for the lower pillow-like casing 10. The edges of the pillow-like casing 10 are inturned over the sub-cover 14, as indicated at 17, and as best seen in FIGS. 2, 3 and 4.

The upper surface of the sub-cover 14 has fastening means applied thereto, which may be cement, as indicated at 18, or other suitable fastening means. The inturned edges 17 of the pillow-like casing 10 are thus secured to the sub-cover 14, to form a container for the flowable granular material 12. The sub-cover 14 has slits 20 and 22 formed therein, so that the portion 24 may be raised, as indicated in FIG. 4 in dot-dash outline, to enable the pillow-like casing 10 to be substantially filled with a flowable, granular material, such as indicated at 12 in FIGS. 2, 3 and 4. The slit 22 is parallel with the corrugations 26 in the sub-cover 14. In this manner the portions 24, when raised, will fold longitudinally along the corrugations 26, which will enable the poetions 24 to be folded back in place, as shown in FIG. 2, after the insertion of the granular material 12 into the bottom pillow-like casing 10.

After the desired quantity of granular material or plastic beads has been inserted into the pillow-like casing 10 through the openings formed in the sub-cover 14 by opening the door-like portions or elements 24, as shown in dot-dash outline in FIG. 4. The door-like elements are then closed and cement 28 is applied around the over-lapping edges of the fabric 16 from which the pillow-like portion is made, and sealing means, such as spots or patterns of cement, as indicated at 30 is applied to the upper surface of the sub-cover 14.

When the pillow-like casing portion 10 has been substantially filled to the desired degree, with lightweight flowable, granular material 12, and the edges 17 of the pillow-like casing portion 10 inturned over the subcovering 14 and the sub-covering 14 secured thereto as by cement or other suitable fastening means, the upper surface of the subcovering receives the sheet of material 4, having a planar surface, which surface is hard, to supply a suitable desk surface. The sheet 4 may be made of wood, hardboard, plastic or the like. The planar sheet may be somewhat greater in dimension than the subcovering 14 or they may be of like dimension, as desired. The subcovering 14 and the planar sheet 4 are permanently secured together by suitable fastening means, which may be a sealing means, such as cement 28 applied in spots or patterns. The members 4 and 14 and 17 are firmly pressed together until the hard sheet of material, which is planar is firmly affixed to the subcovering 14.

What is claimed is:

1. A lightweight portable desk adapted to be placed on and conform to regular and irregular base surfaces, comprising planar hard desk surface means, flexible casing means attached to the bottom periphery of said desk surface means, said flexible casing means attached to the periphery of partially rigid sheet means which is substantially coplanar with said desk surface means and secured to the bottom thereof, said casing means being substantially filled with a lightweight flowable granular material, said granular material having a suitable density and looseness whereby said desk can be placed on any base surface and said desk surface can be adjusted to a desired angular position by readily shifting said lightweight flowable material within said flexible casing to thereby conform said casing and flowable material to the contour and shape of said base surface.

2. The portable desk of claim 1, wherein said flexible casing means is a flexible fabric material.

3. The portable desk of claim 1, wherein said granular material is a lightweight, expanded, foamed plastic material.

4. The portable desk of claim 3, wherein said foamed plastic material is expanded polystyrene.

5. The portable desk of claim 3, wherein said foamed plastic material is styrofoam.

6. The portable desk of claim 1, wherein said granular material is sawdust.

7. The portable desk of claim 1, wherein said casing means is a flexible plastic material.

8. The portable desk of claim 1, wherein said desk surface means comprises longitudinal upstanding stop means along an edge thereof.

9. The portable desk of claim 1, wherein said partially rigid sheet means has door like openings through which said granular material has been inserted prior to attachment of said sheet means to said desk surface means.

10. The portable desk of claim 1, wherein said casing means is inturned over at least a portion of said partially rigid sheet material around the periphery thereof.

11. The portable desk of claim 1, wherein said partially rigid sheet means is a corrugated material.

* * * * *